US006774782B2

(12) United States Patent
Runyon et al.

(10) Patent No.: US 6,774,782 B2
(45) Date of Patent: Aug. 10, 2004

(54) RADIO FREQUENCY PERSONNEL ALERTING SECURITY SYSTEM AND METHOD

(75) Inventors: Larry Runyon, Richland, WA (US); Wayne M. Gunter, West Richland, WA (US); Ronald W. Gilbert, Benton City, WA (US)

(73) Assignee: Battelle Memorial Institute, Richland, WA (US)

( * ) Notice: Subject to any disclaimer, the term of this patent is extended or adjusted under 35 U.S.C. 154(b) by 8 days.

(21) Appl. No.: 10/042,742

(22) Filed: Sep. 23, 2002

(65) Prior Publication Data

US 2003/0076230 A1 Apr. 24, 2003

Related U.S. Application Data

(63) Continuation of application No. 09/885,390, filed on Jun. 19, 2001, now abandoned.
(60) Provisional application No. 60/287,058, filed on Apr. 27, 2001.

(51) Int. Cl.[7] ..... G08B 26/00
(52) U.S. Cl. ..... 340/505; 340/539.1; 340/539.11; 340/539.13; 340/571; 340/573.1
(58) Field of Search ..... 340/505, 539.1, 340/539.11, 539.13, 571, 572.1, 573.1

(56) References Cited

U.S. PATENT DOCUMENTS

| | | | | |
|---|---|---|---|---|
| 3,582,931 A | | 6/1971 | Nawrocki | |
| 3,609,741 A | | 10/1971 | Miller | |
| 3,891,980 A | | 6/1975 | Lewis et al. | |
| 4,553,136 A | | 11/1985 | Anderson, III et al. | |
| 4,688,026 A | | 8/1987 | Scribner et al. | |
| 4,794,470 A | | 12/1988 | Lauffenburger et al. | |
| 4,862,160 A | | 8/1989 | Ekchian et al. | |
| 5,081,446 A | | 1/1992 | Gill et al. | |
| 5,325,084 A | | 6/1994 | Timm et al. | |
| 5,376,921 A | | 12/1994 | Trikilis | |
| 5,874,896 A | | 2/1999 | Lowe et al. | |
| 5,917,425 A | | 6/1999 | Crimmins et al. | |
| 5,942,987 A | | 8/1999 | Heinrich et al. | |
| 5,960,085 A | | 9/1999 | de la Huerga | |
| 5,963,134 A | | 10/1999 | Bowers et al. | |
| 6,008,727 A | | 12/1999 | Want et al. | |
| 6,057,756 A | * | 5/2000 | Engellenner | 340/505 |
| 6,094,137 A | | 7/2000 | Rasch et al. | |
| 6,100,806 A | | 8/2000 | Gaukel | |
| 6,104,295 A | | 8/2000 | Gaisser et al. | |
| 6,111,502 A | | 8/2000 | Lenglart et al. | |
| 6,121,878 A | | 9/2000 | Brady et al. | |
| 6,176,425 B1 | | 1/2001 | Harrison et al. | |
| 6,195,006 B1 | | 2/2001 | Bowers et al. | |
| 6,300,872 B1 | * | 10/2001 | Mathias et al. | 340/540 |
| 6,317,028 B1 | * | 11/2001 | Valiulis | 340/10.1 |
| 6,323,773 B1 | | 11/2001 | Runyon et al. | |
| 6,335,686 B1 | * | 1/2002 | Goff et al. | 340/10.1 |

FOREIGN PATENT DOCUMENTS

| | | |
|---|---|---|
| FR | 2776 101 | 3/1998 |
| WO | WO 00/33274 | 6/2000 |
| WO | PCT/US02/13036 | 9/2002 |

* cited by examiner

*Primary Examiner*—Daryl Pope
(74) *Attorney, Agent, or Firm*—Wells St. John, P.S.

(57) ABSTRACT

A system for reducing security risks in, for example, an enclosed area where there are documents, computer discs, and other items which may contain security sensitive information. Each security sensitive item has an RFID tag attached thereto, and during non-working hours these items are placed in locked file cabinets, a safe or a vault. The area is periodically interrogated by an RF interrogator to ascertain whether the items are in their locked secured position or are in an open area.

37 Claims, 3 Drawing Sheets

RADIO FREQUENCY PERSONNEL ALERTING SECURITY SYSTEM AND METHOD

CROSS REFERENCE TO RELATED APPLICATIONS

The present application is a continuation application of and claims priority to a U.S. patent application Ser. No. 09/885,390, filed on Jun. 19, 2001 now abandoned, entitled "Radio Frequency Personnel Alerting Security System and Method" which claims priority to U.S. Provisional Application Serial No. 60/287,058, filed Apr. 27, 2001, entitled "Radio Frequency Personnel Alerting Security System and Method", the teachings of both applications are incorporated herein by reference.

FIELD OF THE INVENTION

The present invention relates to a system and method for maintaining security and safety of various items, and also for maintaining security in a security sensitive area, and particularly in an area where there are a fairly large number of security sensitive items which are stored in a secured location or locations, such as in a safe, vault, individual secured roms, locked file cabinet, locked drawers, etc.

BACKGROUND OF THE INVENTION

A significant challenge in both government and in industry is maintaining security for information and also other items of value where these are handled in, for example, an area such as an office building or section thereof where a wide variety of security sensitive documents, communications, computer discs, etc. are present. Such items are often taken out of a locked cabinet or other secure place to be used for a period of time, and then are to be returned to the secured location (e.g. the locked file cabinet). Also, computer related information on floppies or hard drives, or possibly other media should be kept in a secure location when these are not being used.

In order to maintain such security it is quite common in government and industrial facilities for security people to go through the security sensitive areas during non-working hours to see if secured documents or the like have been left on people's desk, whether locked file cabinets have been locked, the safe properly closed, etc. In addition to the efforts of such security personnel to inspect the secured area work place regularly, security professionals have for years embarked on educational programs to sensitize the work force to these sort of problems (and to heighten and sustain employee awareness in protecting classified information and sensitive proprietary information). Security professionals have traditionally focused their efforts at least in part on such things as security posters, warning signs, videos, security briefings, etc. to help remind employees of their day to day responsibilities for protecting information.

However, various scientific studies have indicated that the typical work environment can sometimes be overcome by "visual pollution". What this means is that there can be so much visual information being pushed at us so that it is all just becoming "part of the woodwork". For example, there could be an outstanding poster at an office exit to remind employees to ensure they have locked their safes. Within a short period of time, however, the poster fails to capture the employees attention.

U.S. Pat. No. 5,376,921 (Trikilis) discloses a security system where there is a magnet at an exit location that creates a magnetic field so that hard or soft ferrous materials on the individual who is passing to the exit would be magnetized sufficiently to generate a signal to a magnetometer. Detection of this ferrous substance causes the locking of the turn style, forcing the individual to a secondary area. A magnetic card, unique to the individual can also be utilized to facilitate identification of an individual prior to entry to the system.

U.S. Pat. No. 4,862,160 (Ekchian et al.) discloses a tag system for taking inventory. There are groups of items in the stocking area and items of each group are tagged with a printed circuit transponder, and by the interrogator the transponders, taking of the inventory is achieved.

U.S. Pat. No. 6,195,006 B1 and U.S. Pat. No. 5,963,134 (Bowers et al) disclose an identification system in a library. Each book in the library has an RFID tag attached thereto, with an antenna for detecting the presence of the article. Further, each patron of the library has an RFID identification tag. There is an interrogator (a mobile interrogator) which can go to different parts of the library or storage areas to take an inventory of the articles that are there. Also, a video camera is provided for capturing images at the check out area, and also a video recorder for storing the video signals. Further, there is an exit interrogator monitoring the exit from the library, which identifies the article that is being taken out of the library. Also, there is a zone interrogator located at an exit of a predefined area in the library which detects the removal of the tagged article from the predefined area. All of this is integrated into a system for checking in, checking out, taking inventory, checking the articles back in, etc. Thus, in addition to monitoring all of these items, this can be utilized as a self service check in/out system. The claims of this patent relate to the self service check out system (claim 1 and following), and other claims relate to inventory control method and system.

U.S. Pat. No. 6,176,425 B1 (Harrison et al) discloses a system for identifying multiple radio frequency based electronic tags. In the background of the invention it is stated that in modern office management where an electronic tag is attached to a physical document, many of these may be placed close together. There is also disclosed a situation where a physical object for some reason may have multiple RFID tags thereon. Various techniques are disclosed for distinguishing these various articles, and one of these is to provide electromagnetic shielding. For example, in FIG. 8 there is shown a moveable disc shaped shield which is rotatably relative to a disc having several attached electronic tags. FIG. 9 shows a slideable shield. The patent shows other techniques related to solving this particular problem.

U.S. Pat. No. 6,121,878 (Brady et al.) discloses an identification tag which is difficult to defeat. The problem that is addressed is that radio frequency identification (RFID which is capable of having a large number of bits of information) may be shielded from the radio link, and thus this is the Achilles heel. However, magnetic electronic article surveillance (EAS) tags are much less easily shielded from low frequency magnetic detection fields. The drawback is that these tags are only capable of storing fewer bits. Accordingly, the identification tag is a combination of both of these where there is a radio frequency transponder comprising tag electronics for storing information and a nonlinear magnetic material associated with the RF tag generating a varying electronic article surveillance magnetic field with a nonlinear magnetic material in a magnetic field. These EAS tags employ the Barkheusen jump effect, which is characterized by a tendency for magnetization induced in a magnetic material to change in discrete steps as an external magnetic field is increased or decreased.

U.S. Pat. No. 6,111,502 (Lenlart et al.) discloses a surveillance system for a building, the operation of which adapts itself to various time periods such as when people are expected within the building structure or the off hours where the premises of the building would have no people therein. First, there is a personal identification system where the authorized people would have identification tags which would be read as they enter or exit from the secured premises. Then there is also a system for detecting the intrusion of unauthorized people in the premises. Also there is a "volumetric" detection means for detecting the presence of a person in the secure premises. There is further a programming time table defining working periods and surveillance periods corresponding to the intrusion detecting means being put into service. The activation of the volumetric detection means can be postponed during periods when the surveillance system is in force where there are authorized people in the secured area.

U.S. Pat. No. 6,104,295 (Gaisser et al.) discloses an electronic hand tag that responds to both radio frequency and infrared waves. This is in the form of a wristband and it has two or more wires, which are electrically insulated from one another. When a wire is broken, this forms a different coded pattern. The intended use of this wristband is in a hospital environment where the health care facility "has hundreds or even thousands of halls, examination rooms, patient rooms. . . " etc. This is an inexpensive and short-term identification band used for knowing a person's location within the health facility, and also performing a function such as monitoring the heart beat to determine how the patient is functioning.

U.S. Pat. No. 6,094,137 (Rasch et al.) discloses a book binding in which an electronic article surveillance marker can be inserted in a manner to make it inconspicuous. The claims of the patent are directed toward the combination of a book cover, a book page, and an EAS marker on which the surveillance information is stored and an adhesive applied between the book cover and the page for securing the book cover to the page and into which the EAS marker is inserted. There are also claims directed toward a machine for accomplishing this and also the method of inserting the marker into the book.

U.S. Pat. No. 6,008,727 (Want et al.) discloses a system where there is a plurality of electronic identification tags with a computer network. The problem that is addressed is that when there are a large number of tags in close physical proximity the reading of these becomes difficult. The patent discusses a large number of ramifications to how the system can be used, but the claims of the patent focus on tags having their unique identification number incorporated in a readable memory, along with an antenna. The tag also has an open or normally closed switch which turns the circuitry on or off, and this may be operated form the interrogator, which could be a hand held computer or other computer. The patent discusses a wide number of applications. For example, in FIG. 1 there is shown a physical object (shown as a cube) having multiple electronic tags on different faces of the cube.

U.S. Pat. No. 5,960,085 (de la Hurga) shows a rather complex system which is presented as being usable in a medical care facility where the record keeping must be maintained by doctors, nurses, and other hospital staff persons. The person has a personal identification badge by which s/he can establish a wireless communication link with a computer terminal to allow the user to log on to the terminal. When the user leaves the terminal the communication link is terminated, causing the computer terminal to lock the keyboard, blank the monitor, and/or log off the computer. Also, the system enables the person with the identification badge to collect digital information from electronic devices that report or gather data regarding the status of the patient. The patent has 26 sheets of drawings showing various flow diagrams as to how this information can be collected, processed, etc.

U.S. Pat. No. 5,942,987 (Heinrich et al.) discloses an RFID system which is adapted for a situation where there are a very large number of tags which are potentially to be contacted. A typical situation is given on column 6, beginning on line 19, which is identifying items at a receiving dock, where many items, perhaps hundreds or even thousands may be presented to the base station (reader). Examples of data include date or time stamps that might indicate when a tag arrives or passes by a location, is purchased, etc., or location information that identifies a place where a tag is currently located or passing to be sent. In this system, the base station sends a communication by radio frequency signal with this signal designating a selected number (subgroup) of tags on all those potentially contacted, and also sending the signal that identifies unselected tags. The selected tags become active. There are follow up steps in this system also.

U.S. Pat. No. 5,917,425 (Crimmens) relates to a method and apparatus for locating a person inside an office building, hospital, or factory and the like. This combines infrared and RF communications. The persons are provided with portable transceivers that receive infrared location coded signals from a room where there is located an infrared transmitter. The transceiver transmits an RF signal with a personal identification number (PIN). These PIN signals are assigned to the person or apparatus whose location in the building is to be monitored.

U.S. Pat. No. 5,874,896 (Lowe et al.) discloses an anti-theft system in which a transponder tag is attached to an article which is to be taken from a store, and the transponder tag is activated by a transmitter near the exit, causing an alarm. However, if a customer has removal authorization as a result of paying for the article, the transponder tag is reprogrammed to modify the operational data store therein.

U.S. Pat. No. 5,325,084 (Timm et al.) discloses a security system where there is a secure area comprising a vestibule with two doors and a plurality of emergency exit doors. The two vestibule doors and all the emergency exit doors are security doors having a locking means and a disabling means for unlocking or disabling the locking means upon the occurrence of any one of certain pre-selected events associated with non-adversarial activity inside the secure area. The various events and procedures by which this is accomplished is described beginning on column 2, line 58 and following on through column 3.

U.S. Pat. No. 5,081,446 (Gill et al.) describes a security tag which is used for a compact disc storage container to monitor theft.

U.S. Pat. No. 4,794,470 (Lauffenburger et al.) discloses a security system where the tag is placed on a magnetic disc. The device interacts with the disc or tape drive to prevent the use of a secure computer.

U.S. Pat. No. 4,688,026 (Scribner et al.) shows the system in which the location or locations of persons or items can be ascertained. This patent discloses this being used in a building where furniture is being located. Each item of furniture is tagged, and the tag responds to a radio query from a portable unit (interrogator).

U.S. Pat. No. 4,533,136 (Anderson et al.) relates to an antipilferage system and markers for the same. There is provided an amorphous ferromagnetic metal marker capable of producing identifying signal characteristics in the presence of an applied magnetic field. More particularly, the marker comprises an elongated, ductile strip of the amorphous ferromagnetic material having a value of magnetostriction near zero.

U.S. Pat. No. 3,891,980 (Lewis et al.), this patent having been issued in 1975, shows a security system for controlling admission of persons to a protected area. The person has a token in his/her pocket which generates two discrete frequencies when s/he approaches a door leading to the restricted area, a sensor of his/her presence sends an initiating signal, which examines the coin, this being picked up by inductive loops adjacent to the door. If the correct signals are being generated the door is automatically opened, but if not the door remains closed and an alarm may be given.

U.S. Pat. No. 3,609,741 (Miller) discloses a system to move an article, such as a piece of baggage. The article that is to be moved is provided with a radio receiver/transmitter. The person authorized to move the baggage or other article may have a key adapted to disable the circuitry against transmission of the changed frequency signal or otherwise alter the signal in a manner indicating the receiver's authorization.

U.S. Pat. No. 3,582,931 (Newrocki) discloses a system to prevent pilferage in stores, warehouses, etc. The article that would be stolen has a radiation producer or actuator 80 which may be a transmitter, transceiver, transponder, transducer or the like, and the actuator is attached to the article of merchandise. It is stated that the actuator 80 may be severed or removed from the merchandiser article being sold at the check out or wrapping counter of a retail store.

SUMMARY OF THE INVENTION

The present invention relates to a method of reducing security risks in an area where there is at least one security sensitive item which has a secured location and/or secured configuration or situation and has a non-secured location and/or a non-secured configuration or situation.

The security sensitive item is provided with an interrogation responsive RFID member attached or otherwise associated with a security sensitive item so as to be in close proximity thereto or so as to have an operative connection or association with the item to be responsive or related to the secured and/or non-secured configuration, situation and/or location of the security sensitive item.

The RFID member is interrogated into a response to a triggering event or in a time period where the item would be desired or expected to be in its at least one secured location and/or configuration or situation in a manner that either a lack of a response would indicate the security sensitive item is in a secured location or configuration or a response or responses of a certain character would indicate that the security sensitive item is in at least one secured location and/or secured configuration or situation.

In a situation where the interrogating of the RFID member in said time or time period or in response to said trigger event or events does not result in the lack of response that would indicate the security sensitive item is in the secured location and/or situation or result in the lack of a response or responses of a character that the security sensitive item is in the secured location and/or secured configuration or situation, there is generated a communication or communications and/or there is generated an occurrence or occurrences designed and/or arranged to in turn result in a remedial step or steps to accomplish having the security sensitive item in a secured location and/or secured configuration.

In an exemplary embodiment of the present invention, the area in which the security risks are to be reduced is an area where there is an operating environment where a person or persons is or are present during operating time periods. Further, the security sensitive item or items desirably in the non-secured location and/or non-secured situation for operating time periods and/or other time periods where the non-secured location or locations and/or non-secured situation is an acceptable security risk.

Further, the security sensitive item or items are desirably in the secured location or locations and/or a secured situation for non-operating time periods and/or other periods where the non-secured location or locations and/or non-secured situation of the security sensitive item is not an acceptable security risk.

Further, the interrogating of the RFID member occurs during at least the non-operating periods and/or periods where the security sensitive item in the non-secured location or locations and/or situation is not an acceptable security risk or in response to a triggering event where the security sensitive item would be desired or expected to be in a secured location or locations and/or situation.

The method further comprises arranging the secured location and/or situation so that with the security sensitive item and its related RFID member in a secured location or locations and/or situation so that either a lack of a response from the related RFID member or a response or responses of a certain character would indicate that the security sensitive item is in the secured location or locations and/or secured situation.

In this exemplary embodiment, the secured location or locations is provided as an electromagnetically shielded location so that when the security sensitive item is located in a secured location or locations, the security sensitive item is shielded from an interrogation signal.

The security sensitive item may be an item which contains or embodies security sensitive information and/or has a value or is of a character which would make it desirable to be in a secured location, in which case this could be placed in the shielded secured location.

Also, the security sensitive item could be one which is arranged to have a secured situation by which another item or items is maintained in a secured location or locations and/or situation. This type of security sensitive item is arranged to have a non-secured situation where the other item or items is in a non-secured location or locations and/or non-secured situation. In one embodiment this can be a containing member, such as a safe, having a secured configuration wherein another item or items are securely contained in the containing member and have a non-secured configuration where the item or items in the containing member are more susceptible to be removed from the containing member. One arrangement is that the containing member has a locking mechanism which has a locked position and an unlocked position.

Also, in the exemplary embodiment, the area where the security sensitive item is located is a secured area where one or more persons are present during the operating periods and is or are engaged in an activity or activities which would reasonably require that the security sensitive item would at least sometimes be in a non-secured location or locations and/or situation within the secured area.

The generating of the communication (s) and/or generating the event is initiated in a situation where:

a) a person in the secured area is approaching an exit from the secured area, is in proximity to the exit, or is passing through the exit; and b) this occurs during a non-operating time period or in some other time period where the non-secured location or locations and/or non-secured situation of the security sensitive item is not an acceptable risk.

The communication or communications is or are directed to the person or persons who are approaching, in proximity to, or passing through the exit in one embodiment. The communication or communications can be a visual communication, an oral communication, or a combination thereof.

In another form, the event which is triggered is creating a physical impedance to the person or persons who are approaching, in proximity to or passing through the exit. In a specific form, the physical impedance comprises locking a door at the exit.

Also, in the event that the physical impedance is initiated, there is a second exit for the secured area so that in an emergency situation, the person or persons are able to pass through the second exit. When the person or persons do pass through the second exit, an alerting communication is generated by this.

In an embodiment of the present invention the interrogating of the RFID member is accomplished by a control/interrogating apparatus initiating an interrogating signal or signals to an interrogating section sending one or more interrogations from one or more antennas into the secured area. The RFID member responds to the interrogating by modulating a response signal which in turn is received and directed to the control/interrogating apparatus.

Also in the exemplary embodiment, there is a plurality of the security sensitive items in the secured area, each having a related RFID member, and each of the RFID members are interrogated. Also, in a specific form of the invention, at least one of the security sensitive items is, in its secured location and/or situation has its RFID member situated so as to receive an interrogating signal. Accordingly, the method further comprises providing an RFID monitoring member which is located to ascertain the RFID member that responds to the interrogation is located in its secured position.

In one form, the RFID monitoring member has at least in part a direct electrical connection with the RFID member that responds to interrogation.

In the system of the present invention, each of the security sensitive items is provided with a related interrogation responsive RFID member as described earlier herein. Also, there is provided the control/interrogating apparatus to interrogate these various RFID members as explained above. These are arranged to accomplish the steps noted above, namely interrogating the RFID members and receiving any modulated reply from the these RFID members which would indicate, either by a lack of a response and/or a response not having a certain character that these would be in a secured location or a secured situation or configuration. Alternatively, a response of a certain character would indicate that these items are in a non-secured location and/or situation. Then the remedial steps would be taken as described above.

Other features of the present invention will be apparent from the following detailed description.

DESCRIPTION OF THE PREFERRED EMBODIMENTS

Figure 1:
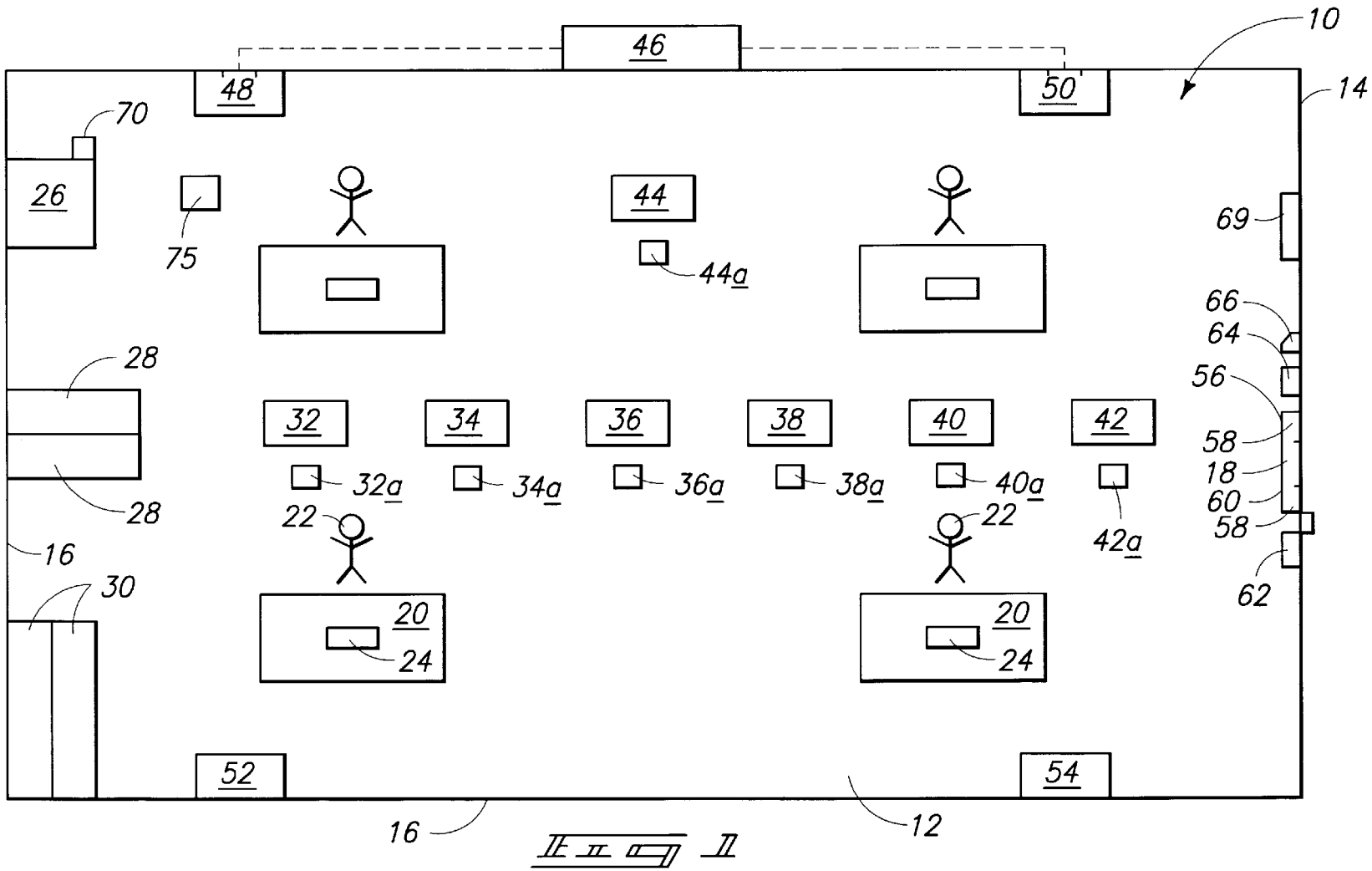
FIG. 1 is a somewhat schematic plan view illustrating the system and method of the present invention.

It is believed that a clearer understanding of the present invention will be obtained by first describing, with reference to FIG. 1 as an example, a typical working environment which is in a security sensitive area, and also describing the main components of the present invention which are positioned and utilized in this environment to implement the present system. Then this will be followed by an overall description of the manner in which the system is operated in a step by step basis. With that being given as an overview, then various specific features and components of the present invention would be described, as well as various alternatives.

a) Overview of the Overall System and Method.

Reference is first made to FIG. 1, where the system of the present invention (indicated by numeral 10) is being utilized in a security sensitive area 12. This particular security sensitive area 12 is shown as a single room positioned within a structure 14 (which may be part of a larger office building), the room being surrounded by four walls 16 and having an exit (i.e. doorway) 18.

In this area 12, there are shown four desks 20, which are provided for four people, indicated at 22 adjacent to the desks, and with each desk being provided with a computer set-up 24. There is along one wall for example, a locked metal safe 26, and also locked file cabinets 28 (two, for example). The safe could be in the form of a metal vault that would be built into the building structure and closed by a vault door. Further, in a corner of the room, there are two non-locked file cabinets 30, which would be used for possibly such things as office supplies, which are not security sensitive items. Alternatively, as a precaution, these two file cabinets 30 could also be locked.

In this office area 12, there could be a variety of security sensitive items, and these are simply shown schematically as small blocks, with numerical designation. Among these could be the following: documents 32, written communications 34, computer hard drives, discs, and other computer information media 36, funds and currency 38, items which contain evidence or evidencery data 40, weapons and munitions 42, high value equipment/materials 44, etc.

It is to be understood that all of the items 12–44 which have been described above would already exist in a typical security sensitive area 12. We will assume that there are large amounts of information which are being developed, exchanged, stored, etc., and that these large amounts of information are recorded in various media, such as hard copy (paper), computer media, or possibly in some other form.

There are a number of problematic situations which can arise in this environment. For example, a person may be doing work on a security sensitive project where it requires him to have some related documents on this desk for long periods of time, and on another part of the desk there are other types of non-sensitive documents relating to other matters. The usual office procedure would be for the security sensitive documents to be placed in the locked file cabinet 28, while other security sensitive items which do not lend themselves (e.g. because of their physical dimensions) or level of sensitivity to be filed in the file cabinet are to be locked in the safe 26. Some of these documents may be left on the person's desk after working hours, possibly within a stack of non-sensitive documents.

Then another problem could arise when the person closes the safe, but fails to turn the dial on the safe the proper number of revolutions so that it locks. Also the locks on the file cabinet may not be placed in the lock position. At the end of the work day, or even at lunch hour, during which the security sensitive items are to be safely stored away (under lock and key), because of some distraction the person may walk out the door leaving the security sensitive documents or items available for theft or inspection by unauthorized personnel.

The system 10 of the present invention is designed to substantially alleviate these problems, and there will now be a description of the main components of the present invention, followed by a brief description of one typical operation of the system.

There is shown schematically a central control/interrogation apparatus 46, and this is operatively connected to a plurality of transmitting/receiving antennas, such as the four antennas shown schematically at 48, 50, 52 and 54 at spaced locations around the perimeter of the area 12. Then there are shown schematically encoded radio frequency identification tags or (RFID) members identified as 32*a* through 44*a*, so that there is one RFID member or tag for each of the corresponding security sensitive items 32–44 to which the tag is attached. There is also shown in FIG. 1 the aforementioned exit opening 18 leading from the security sensitive area 12, and this opening 18 would normally be the existing doorway 56 which is closed by a door 58 having a handle indicated at 60.

As part of the system of the present invention there is provided adjacent to the doorway 18 a personnel proximity detector 62 located immediately adjacent to the door 58, a visual display 64, an aural output device 66, a door locking mechanism 68, and a nearby emergency exit (door) at 69.

To describe briefly each of these components, each of the RFID members or tags 32*a*–44*a* can be of conventional design and be passive tags which are energized by the interrogating signal and reflect or modulate an encoded response to the source to identify the item to which it is attached. The central control/interrogating apparatus 46 performs a number of functions. First, the apparatus 46 sends interrogating signals to the antennas 48–54 and these signals radiate from each antenna 48–54 into the security sensitive area 12. In the presently preferred embodiment, the apparatus 46 has stored in its database the encoded identification number for each of the tags 32*a*–44*a*, and the individual tags 32*a*–42*a* are interrogated sequentially so that the response from the tags 32*a*–44*a* are also received sequentially to be processed in the apparatus 46. This will be described further later herein.

The personnel proximity detector 62 may be a conventional design, and may be in the form of a motion detector, which would sense the situation where a person has come within close proximity to the door 58 (e.g. within 24 inches), an infra-red detector, or other types of detectors. The visual display 64 functions (as its name implies) to display a communication, such as a message, flashing lights, a combination of these, etc. In like manner, the aural output device 66 has the capability of transmitting an audible message. The door locking control device 68 may incorporate the option of locking the door 58 so that it cannot be opened, except under certain circumstances, or at least opened with moderate difficulties. Alternatively, there could be a warning device which could transmit a warning sign of higher urgency.

With the foregoing description of the various main components being given, let us now review a typical situation during a workday in the operating area 12. Let us assume that this is a typical workday where the employees arrive at the morning hour of 8:30AM, have an hour break for lunch between 12:00PM and 1:00PM, and leave the work area 12 at 5PM.

We will assume that all of the security sensitive items 32–44 have been properly stored overnight in either the safe or vault 26 or in one of the locked file cabinets 28. Also, we will assume that the metal walls of the safe 26 and also the metal walls of the locked cabinets 28 are sufficiently thick (or lined with a metallic layer of sufficient thickness) to effectively block the interrogating electromagnetic signals emitted from the antennas 48–54. Therefore, prior to 8:30AM when the office area 12 is opened, when the apparatus 46 sends out interrogating signals, these signals should not reach any of the tags 32*a*–44*a* since the security sensitive items 32–44 with their respective tags 32*a*–44*a* thereon are all locked in the metal safe 26 or metal cabinets 28. In this instance the central control/interrogation apparatus 46 would be able to record (or deliver to its central control unit elsewhere in the building) an "everything is okay" signal, which means that all of the sensitive security items 32–44 remain in a safely locked position.

Now the day's work begins, and as needed, the employees will open the locked file cabinets 28 as needed and also the safe 26, and various documents, communications, etc. will be taken out periodically and possibly remain outside of the file cabinets 28 or safe 26 for an extended period of time during the day.

When 12:00PM is reached and it is time to leave the security sensitive area 12 for lunch, all of the security sensitive items 32–44 should be placed in the secured locations, which in this instance are assumed to be only the two file cabinets 28 and the safe 26. However, let us further assume that several security sensitive items have been left out on, for example, a person's desk.

As the first person going to lunch approaches the doorway 56, the proximity detector 62 (e.g. simply a motion detector, possibly an infra red detector, etc.) senses that a person is approaching the detector, likely to leave the secured area. This information is transmitted promptly to the central control/interrogation apparatus 46, which rapidly sends out a series of interrogating signals for each and every security sensitive item 32–44. Since several of these items 32–44 are not shielded from the interrogation pulses, each of these responds by sending an encoded return signal indicating that "I am here in the open, and have not been securely locked away." Accordingly, when the apparatus 46 receives this message, it immediately signals an "alert" or an "alarm" signal to both the visual display 64 and the aural output device 66 as an immediate and urgent reminder that the area 12 has not been made secure (i.e. one or more security sensitive items have been left in an unprotected location). In spite of this warning, if the door is opened by the person leaving for lunch, and one or more persons start to leave, then a more urgent signal would be emitted. As an added precaution (as indicated above), the controller could cause the locking mechanism to be activated to lock the door 18 and prevent the door 18 from being opened.

If proper procedure is being followed, the employee(s) about to leave the premises, would move back from the doorway or walk back in, shut the door and then the non-protected sensitive security items 32–44 would be ascertained and placed in the appropriate secure location (i.e. the safe 26 or the file cabinets 28, and also with these being locked). In the meantime, the visual display 64 would keep flashing or emitting some other additional signal, and the aural output 66 would also keep broadcasting its warning. During this same time period, the apparatus 46 would continue its cycles of interrogation, and only when the apparatus 46 finds that all of the security sensitive items 32–44 are back in their secured position, then the alert-alarm signals will stop. At that time, an "all is well signal(s)" could be transmitted. Then after the first person approaches the door 58 and opens the door, all of the personnel are able to pass through and go to lunch.

Now let us pause and think for a moment of "what can go wrong with this procedure?" Let's select one example, and this is that several of the out-of-place items are placed in the safe. Then the safe is opened, the security sensitive items are placed in the safe 26, the safe door is shut, and the dial on the safe is turned to lock the safe. However, let us assume that it takes six full revolutions of the dial on the safe 26 to properly lock the safe, and the person carelessly rotates the dial only four or five times, thus leaving open the opportunity for an unauthorized person to open the safe.

To alleviate this, there also must be an RF responsive mechanism to indicate whether the safe is properly locked, and as an example such a mechanism is indicated in FIG. 1 at 70. This security device 70 will be described later herein, and is mentioned at this stage only to indicate, by way of example, another facet of the present invention. Other counting mechanisms could be used, or a sensing device to be responsive to a properly locked position of the safe locking mechanism.

With the foregoing being given as an overview, we will now proceed to a more detailed discussion of various features and components of the present invention.

b) Central Control/Interrogation Apparatus 46.

Figure 2:
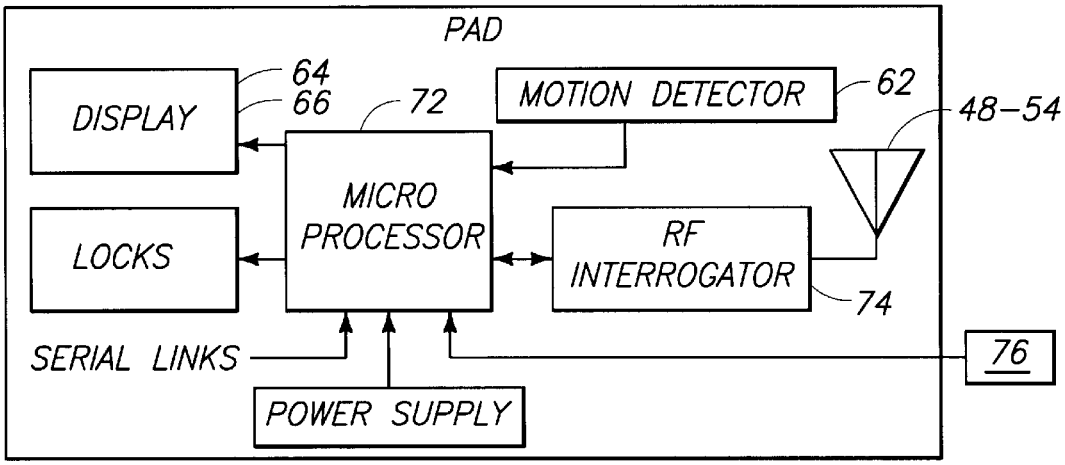
FIG. 2 is a block diagram central control interrogating apparatus of the present invention.

Reference is now made to the schematic drawing of FIG. 2, which shows the main components of this apparatus 46 in conjunction with the other components with which it is associated. Basically, this apparatus 46 comprises a microprocessor 72 which performs a variety of functions. First, the database of the microprocessor 72 stores the information of all of the RFID tags 32*a*–44*a*. With this information, the microprocessor 72 is able to send interrogation signals to the interrogator 74, which in turn broadcasts the interrogation electromagnetic waves through the antennas 48–54.

It can also be seen that the microprocessor 72 is able to have connections to various other components. For example, the microprocessor 72 (quite possibly with hard wiring) could be connected to a central facility 76 which would be able to gather the information from microprocessors 72 at various security sensitive monitoring locations. By having such a central facility this could reduce or eliminate the need to monitor the security systems at the specific security sensitive area 12 as shown herein.

To review now briefly the functions of the microprocessors 72 in conjunction with the other item shown at FIG. 2, the interrogator 74 transmits the encoded pulses through the antennas to the various tags 32*a*–44*a* and (as explained earlier) the reflected modulated signals which are returned from the various tags 32*a*–44*a* are sent from the interrogator back to the microprocessor. If it turns out that one or more of the security sensitive items 32–44 should be in a secured location, but are out of a secured location, then, as indicated previously, the displays or outputs (including the visual display 64 and the oral output 66) transmit their warning signals.

During this time period the microprocessor sends interrogating signals at close time intervals to the interrogator 74 until all of the security sensitive items 32–34 are safely put away, the appropriate locking mechanisms locked, and other procedures accomplished which may be necessary to ensure the security of the area 12. At this time the microprocessor will send signals to the visual display 64 and the aural output 66 to turn them off. Also, in the event that the microprocessor has operated the locking mechanism 68 to lock the door, this will be released to allow the personnel to exit through the doorway.

It was indicated previously that there is an emergency exit 69. Let us assume that the reason for leaving the secure area 12 is for an emergency, such as a fire or possibly an attack by some unauthorized personnel armed with weapons. In this instance, the employees would exit rapidly through the emergency exit 69, and this would be signaled to the microprocessor which would send out emergency signals to the appropriate locations so that remedial action could be taken, whether it be a fire-fighting emergency, a SWAT team type emergency to combat armed intruders, etc.

c) More About the RFID Tags 32*a*–44*a*.

These RFID tags are desirably made as passive tags of conventional design. As is noted in the prior art, these tags are able to come in a wide variety of shapes and sizes, and can even be made as small as pencil lead in diameter and one half inch in length. The passive tags operate without a separate external power source and obtain operating power from the electromagnetic waves emitted from the antennas 48–54. This makes them less expensive and offers a virtually unlimited operating life time. These are read/right tags and (as indicated previously) are programmed with a unique set of data (which could be between 32 and 128 bits, depending upon the amount of information which is to be modulated). With regard to frequency, these would be desirably operated at a higher frequency, such as 2.45 GHZ. The practical range for reception from the signals from the tags would normally extend beyond the range in which they are positioned. Further, this frequency choice (2.45 GHZ) allows a spread spectrum capability, which adds privacy, reliability and margin to the system. Obviously within the broader scope of the present invention, other design options of the RFID tags or members could be used, and they could each have their own power source (e.g. a battery).

d) Other Functions of the System.

In addition to performing the security functions as described above, this system could provide other advantages. For example, it could be used for inventory control. In the preferred embodiment of this intention, every single security sensitive item is provided with an RFID tag. Accordingly, inventories could be taken periodically and not only of all of the security sensitive items in the area 12, but also their particular locations. A mobile antenna (indicated schematically at 75) of the interrogator could be positioned for a short time inside of the safe to take an inventory of all items in the safe periodically.

Also, this could quite possibly be done with individual file drawers in the security file cabinets by taking these periodic inventories and comparing these with prior inventory in the database. There could be detected, for example, unauthorized or accidental movement of a security sensitive document out of the area 12 through some accident, possibly by removal of the same by, for example, placing the document within a metallic case which provides an electromagnetic shield.

Another facet of the system of the present invention is that each of the personnel would wear encoded RFID identification tags, and the identification of the person could be correlated in some manner with the security breeches (e.g. leaving exposed sensitive material at the wrong times). For example, in the database there could be entered a responsible person for certain proprietary documents which might be in his area of activity, and these particular documents which are mistakenly left out of the secured areas at the wrong time could be correlated with that person to allocate responsibility. Further, this could provide a motive for greater caution in that if one particular employee is more frequently the cause of the delays in moving out of the secured area, peer pressure would be a motivation to be more cautious in filing away in secured places the proprietary or security sensitive material.

Another possible option is that the present system could be utilized for identifying which documents have been left out of the secured locations, but also the location of the same. For example, let it be assumed that a particular RFID tag is identified as being out of a secured location, for example, on someone's desk, in a pile of papers. Once the RFID tag itself has been identified, then a system to identify the distance of the that particular RFID tag from two antennas could be ascertained. There are various methods in the prior art by which distance can be ascertained electromagnetically, and one of these would be, for example, where pulses are sent at different frequencies, and the return signal from the object responds at a tuned frequency and will modulate back to the sending location. When there is a proper match of the frequency with the distance, then a null will be detected at the receiving locations, and by knowing the frequency, the wave length will be calculated, and thus also the distance. Then the distance between two antenna locations (of the antennas 48–54) could be ascertained and by triangulation the location of the security sensitive tag could be determined.

In the preferred embodiment described herein, the security sensitive items are stored in a metallic container or containing structure (i.e. the safe 26 or the metallic locked cabinets 28). Within the broader scope of the present invention, it may also be possible to store the security sensitive documents in a locked container (i.e. a locked desk drawer) where there is not sufficient metal shielding to shield the RFID tag from the interrogating antenna 48–54).

When some security sensitive documents are locked in a cabinet without electromagnetic shielding, one possibility is that in this particular locked drawer where security sensitive items are to be stored, there could be a local active RFID identifying member that is responsive to an interrogating signal from the control/interrogating apparatus 46 and would take an inventory of the RFID tags within that particular container. Then when the interrogating signals are transmitted to the entire secured area, in addition to the identification of these tags in that particular locked drawer being sent back to the interrogator, there is also a signal from the local active RFID identifying member that has a monitoring function that takes its own inventory of tagged items in that drawer and transmits a signal back to the central control/interrogating apparatus 46 that these particular tagged items'are in the locked drawer and thus properly contained in a secured location.

However, there is a potential problem in that this active RFID monitoring tag may also transmit its signal outside of the containing structure to transmit to an item outside of the secured file drawer.

One possible way to resolve this is that there could be a direct electrical connection between the local active RFID identifying member and each of the tags that are on a document. For example, the file cabinet itself could have a pair of metal parallel hang rails 80 with at least one of these being electrically conductive, and the RFID tag 34*a* could have an electrically conductive connection to the electrically conductive hang member 82 that would hang on to this particular conductive rail, and thus could communicate electrically directly through this rail 80, which in turn would be electrically connected to the local active RFID identifying member 84. Then when the central interrogator detects the presence of these tags 34*a*, in addition to responding back to the interrogator 74 electromagnetically, each tag 34*a* would also send its encoded signal electrically back to the local active RFID interrogating member which then would send its signal identifying the various tags for which it has "responsibility".

Alternatively, the interrogating signal from the interrogator 74 could directly activate the local identifying member 84 which would in turn interrogate the tags 34 in the file cabinet, either electrically or through its own RFID signal and receive the reply signal directly either electrically or as an RFID signal. Other arrangements are also possible.

e) Other Monitoring Techniques.

Figure 3:
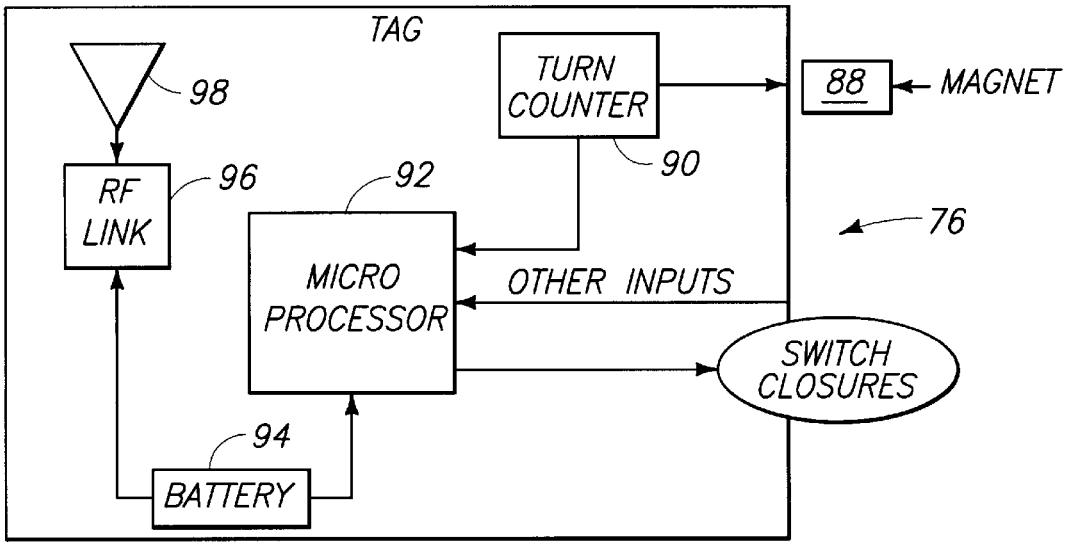
FIG. 3 is a block diagram illustrating a specific embodiment by which a safe having a locking mechanism can be monitored in the system of the present invention to see if the safe is properly locked.
Figure 4:
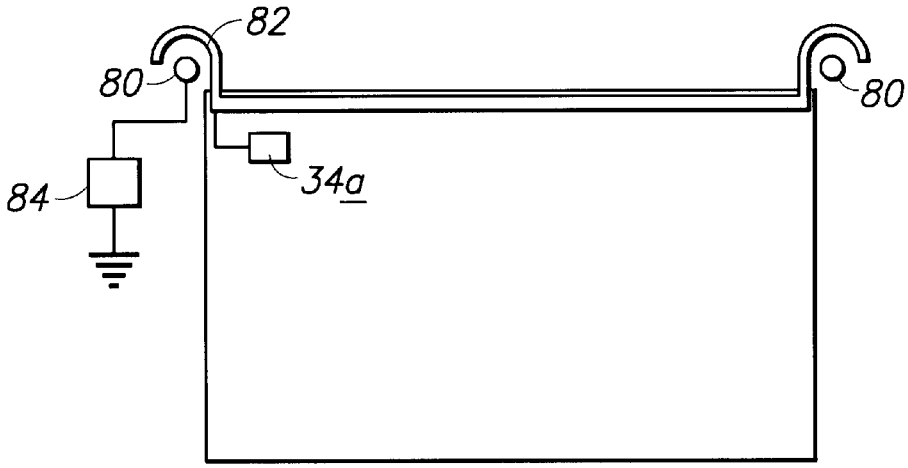
FIG. 4 is an elevational view showing an embodiment where a monitoring apparatus is arranged to ascertain the presence of a security sensitive item in a container-which is not shielded from the interrogating signal.

Previously in this text, it was indicated that there would be a description of the use of the monitoring device 70 which indicated that the dial of the safe had been rotated the proper number of times so that the safe would be locked. A schematic diagram of this particular device 70 is shown in FIG. 3. The RFID tag dial monitor could reside on base adjacent to the dial. This device could be, for example, approximately 1"×1"×2", and it would monitor the dial of the safe in such a way that in closing and locking the door of the safe, but without the correct number of turns after the closure would result in an error condition with an appropriate activation of a warning light and alarm.

With reference to FIG. 3, there is shown a magnetic element 88 which would turn with, or in response to, the rotating dial in some manner so that it would pass by a turn counter 90 that would deliver the information concerning the number of turns to a microprocessor 92. There is a small battery 94 that powers the microprocessor 94 and also the RF link 96 connected to the antenna 98. When the proper number of turns of the dial have been made, then the microprocessor transmits an "okay" signal to indicate that the dial on the safe has been turned the proper number of times, and thus the safe is properly locked.

Figure 5:
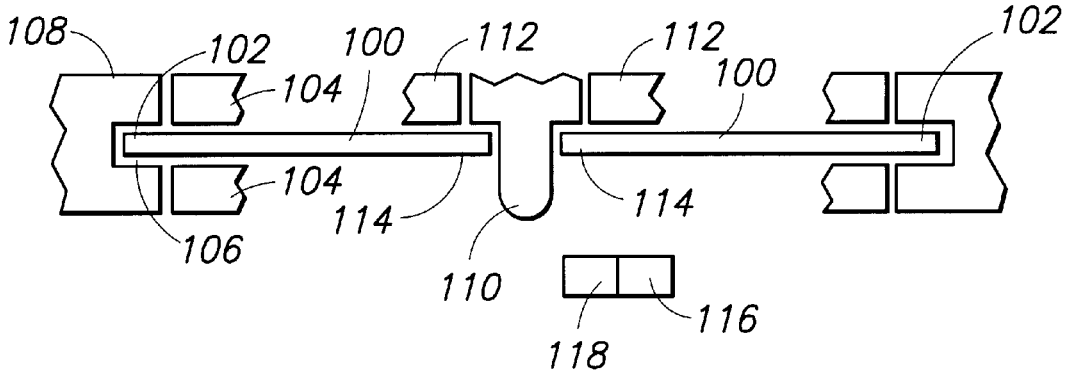
FIG. 5 is a somewhat schematic drawing showing a monitoring arrangement for a locking mechanism where an audible sound is sensed to indicate a secured position.

Another possible option is an arrangement shown in FIG. 5 where the door of the safe is provided with two locking bars which extend in opposite directions from one another, and the outer ends 102 of these two locking bars 100 are moveable laterally so that they can be moved away from each other outwardly through the side edges of the door (only portions of which are shown schematically at 104 in FIG. 5) into recesses 106 in the safe structure 108 (portions of which are shown schematically in FIG. 5) and thus accomplishing the locking of the door. This can be accomplished by turning a handle from outside the safe. When the two bars are in their locking position, then a bolt 110 which extends from a lock dial housing (portions of which are shown schematically at 112) moves downwardly from its retracted position into its extended locking position, as shown in FIG. 5, where it is positioned between the proximate ends 114 of the bolt to prevent the two bars 100 from being moved toward their unlocked position. Then when the safe is unlocked by raising the bolt 110, the handle on the outside of the safe door is then able to retract the two locking bars.

In this particular configuration, when the bolt 110 is permitted to drop downwardly into its locking position, it produces a sound. Then a sound detecting mechanism 116 that is responsive to that sound of the bolt 110 dropping signals the associated RFID tag or member (indicated schematically at 118) respond to the interrogation by indicating that the safe has been properly locked. Alternatively, the tag 118 could send the signal to the control/interrogating apparatus 46 as soon as the sound of the dropping bolt 10 is detected.

Within the broader scope of the present invention, the signal to indicate "the safe is locked" could be done in yet other ways. In general, this signal could be made responsive to movement of some member associated with the safe locking structure which is responsible for injecting the bolt into its secure position. Also, there could be a mechanical sensor which is moved by the locking operation to close or open a switch. Further, there could be an electromagnetic sensor to sense when the bolt is in its locking position. These are given by way of example, and yet other devices could possibly be used.

It can readily be recognized that mechanisms of this sort could be used, for example, to monitor other mechanical or electrical devices within the security sensitive area 12. For example, the closure of a locking element could close an electrical contact which in turn would be transmitted to the small microprocessor that in turn would cause the appropriate RF signal to be transmitted back to the interrogator.

It is evident that various modifications, additions or deletions could be incorporated in the system and method of the present invention without departing from the basic teachings thereof. Also, the various elements and steps described herein are exemplary of an embodiment which is presently considered to be a preferred embodiment, and these are to be interpreted to include equivalents thereof. For example, the term "radio frequency" or "RFID" refers to items and technology that would normally operate within the limits of radio frequency electromagnetic waves. However, it is to be understood that it may be possible and/or practical to utilize electromagnetic waves which would literally be outside of this range, and yet accomplish the same or equivalent results of the present invention, and the present invention is intended to include these.

What is claimed is:

1. A method of reducing security risks in an area where there is an operating environment where a person or persons is or are present during operating time periods and there is at least one security sensitive item which has a non-secured location or locations and/or non-secured situation for the operating time periods and/or other time periods where the non-secured location and/or non-secured situation of the security sensitive item is an acceptable security risk, and which has a secured location or locations and/or a secured situation for non-operating time periods and/or other periods where the non-secured location or locations and/or non-secured situation of the security sensitive item is not an acceptable security risk, said method comprising:

a) providing said security sensitive item with a related interrogation responsive RFID member attached or otherwise associated with the security sensitive item so as to be in close proximity thereto, or so as to have an operative connection or association with said item so as to be responsive or related to the secured and/or non-secured location or locations and/or situation of the security sensitive item;

b) interrogating said RFID member at least during the non-operating periods or other periods where the security sensitive item in the non-secured location or locations and/or situation is not an acceptable security risk or in response to a triggering event where the security sensitive item would be desired or expected to be in its said secured location or locations and/or situation;

c) arranging the secured location or locations and/or situation so that with the security sensitive item and its related RFID member in the secured location or locations and/or situation either a lack of a response from the related RFID member or a response or responses of a certain character would indicate that the security sensitive item is in the secured location or locations and/or secured situation;

d) in a situation where the interrogating of the RFID member does not result in said lack of response that would indicate the security sensitive item is in the secured location or locations and/or secured situation or does result in said lack of a response or responses of a character that indicates the security sensitive item is in the secured location and/or secured configuration, generating a communication(s) and/or generating an occurrence(s) designed and/or arranged to result in a remedial step or steps to accomplish having the security sensitive item in said secured location or locations and/or secured situation and/or initiating some other remedial course of action.

2. The method as recited in claim 1, wherein said secured location or locations is provided as an electromagnetically shielded location so that when the security sensitive item is located in the secured location or locations, the security sensitive item is shielded from an interrogation signal.

3. The method as recited in claim 2, wherein said security sensitive item contains or embodies security sensitive information and/or has a value or is of a character which would make it desirable to be in a secured location.

4. The method as recited in claim 1, wherein the security sensitive item is arranged to have a secured situation by which another item or items is maintained in a secured location or locations and/or situation, and said security sensitive item is arranged to have a non-secured situation where said another item or items is in a non-secured location or locations and/or non-secured situation.

5. The method as recited in claim 4, wherein said security sensitive item comprises a containing member having a secured configuration wherein another item or items are securely contained in said containing member and having a non-secured configuration wherein an item or items in the containing member are more susceptible to be removed from the containing member.

6. The method as recited in claim 5, wherein said containing member has a locking mechanism, and said locking mechanism has a locked position and an unlocked position, said locking mechanism being arranged so that in the unlocked position, there is either a lack of response to an interrogation or a response of a character indicating that a locking mechanism is in an unlocked configuration.

7. The method as recited in claim 1, wherein said area where the security sensitive item is located is a secured area where one or more persons are present during the operating periods, and is or are engaged in an activity or activities which would reasonably require that the security sensitive item would at least sometimes be in a non-secured location or locations and/or situation within the secured area.

8. The method as recited in claim 7, wherein the generating of a communication(s) and/or generating the event is initiated in a situation where a) a person in the secured area is approaching an exit from the secured area, is in proximity to said exit, or is passing through said exit; and b) this occurs during a non-operating time period or in some other time period where the non-secured location or locations and/or non-secured situation of the security sensitive item is not an acceptable security risk.

9. The method as recited in claim 8, wherein said communication and/or communications is or are directed to the person or persons who are approaching, in proximity to, or passing through the exit.

10. The method as recited in claim 9, wherein said communication(s) is selected from a group comprising a visual communication, and aural communication and a combination thereof.

11. The method as recited in claim 8, wherein said invention comprises creating a physical impedance to the person or persons who is or are approaching, in proximity to or passing through the exit.

12. The method as recited in claim 11, wherein the physical impedance comprises locking a door at the exit.

13. The method as recited in claim 11, where there is a second exit from the secured area, so that in an emergency situation, the person or persons are able to pass through the second exit.

14. The method as recited in claim 13, wherein an alerting communication is generated by the person or persons passing through the second exit.

15. The method as recited in claim 1, wherein the interrogating of the RFID member is accomplished by a control/interrogating apparatus initiating an interrogating signal or signals to an interrogating section, with said interrogating section sending one or more interrogations from one or more antennas into the secured area, and the RFID member responds to the interrogating by modulating a response signal which is in turn is received and directed to the control/interrogating apparatus.

16. The method as recited in claim 15, wherein there is a plurality of security sensitive items each having a related RFID member, and each of the RFID members are interrogated.

17. The method as recited in claim 16, wherein at least one of the security sensitive items, in its secured location and/or situation, has its RFID member situated so as to receive an interrogating signal, said method further comprising providing a monitoring member which is located to ascertain that said at least one of the security sensitive items having the RFID member that responds to interrogation is in its secured location or situation.

18. A method of reducing security risks area where there is at least one security sensitive item which has a secured location and/or secured situation and has a non-secured location and/or a non-secured situation, said method comprising:

a) providing said security sensitive item with an interrogation responsive RFID member attached or otherwise associated with the security sensitive item so as to be in close proximity thereto, or so as to have an operative connection or association with said item to be responsive or related to the secured and/or non-secured location and/or situation of the security sensitive item;

b) interrogating said RFID member in response to a triggering event or in a time period where the item would be desired or expected to be in its said at least one secured location and/or situation in a manner that either a lack of a response would indicate the security sensitive item is in a secured location or situation or a response or responses of a certain character would indicate that the security sensitive item is in at least one of said secured location and/or secured situation;

c) in a situation where the interrogating of the RFID member in said time period or in response to said triggering event does not result in said lack of response that would indicate the security sensitive item is in the secured location and/or situation or result in said lack of response or responses of a character that the security sensitive item is in the secured location and/or secured situation, generating a communication(s) and/or generating an occurrence(s) designed and/or arranged to in turn result in a remedial step or steps to accomplish having the security sensitive item in said secured location and/or secured situation.

19. The method as recited in claim 18, wherein said secured location or locations is provided as an electromagnetically shielded location so that when the security sensitive item is located in the secured location or locations, the security sensitive item is shielded from an interrogation signal.

20. The method as recited in claim 18, wherein the security sensitive item is arranged to have a secured situation by which another item or items is maintained in a secured location or locations and/or situation, and said security sensitive item is arranged to have a non-secured situation where said another item or items is in a non-secured location or locations and/or non-secured situation, and wherein said security sensitive item comprises a containing member having a secured configuration wherein another item or items are securely contained in said containing member and having a non-secured configuration wherein an item or items in the containing member are more susceptible to be removed from the containing member.

21. The method as recited in claim 20, wherein said containing member has a locking mechanism, and said locking mechanism has a locked position and an unlocked position, said locking mechanism being arranged so that in the unlocked position, there is either a lack of response to an interrogation or a response of a character indicating that a locking mechanism is in an unlocked situation.

22. The method as recited in claim 18, wherein the interrogating of the RFID member is accomplished by a control/interrogating apparatus initiating an interrogating signal or signals to an interrogating section, with said interrogating section sending one or more interrogations from one or more antennas into the secured area, and the RFID member responds to the interrogating by modulating a response signal which is in turn is received and directed to the control/interrogating apparatus.

23. The method as recited in claim 22, wherein there is a plurality of security sensitive items each having a related RFID member, and each of the RFID members are interrogated.

24. The method as recited in claim 23, wherein at least one of the security sensitive items, in its secured location and/or situation, has its RFID member situated so as to receive an interrogating signal, said method further comprising providing a monitoring member which is located to ascertain that said at least one of the security sensitive items having the RFID member that responds to interrogation is in its secured location or situation.

25. A system for reducing security risks in an area where there is an operating environment where a person or persons is or are present during operating time periods and there is at least one security sensitive item which has a non-secured location or locations and/or non-secured situation for the operating time periods and/or other time periods where the non-secured location and/or non-secured situation of the security sensitive item is an acceptable security risk, and which has a secured location or locations and/or a secured situation for non-operating time periods and/or other periods where the non-secured location or locations and/or non-secured situation of the security sensitive item is not an acceptable security risk, said system comprising:

a) said security sensitive item being provided with a related interrogation responsive RFID member attached or otherwise associated with the security sensitive item so as to be in close proximity thereto, or so as to have an operative connection or association with said item so as to be responsive or related to the secured and/or non-secured location or locations and/or situation of the security sensitive item;

b) a control/interrogating apparatus to interrogate said RFID member at least during the non-operating periods or other periods where the security sensitive item in the non-secured location or locations and/or situation is not an acceptable security risk or in response to a triggering event where the security sensitive item would be desired or expected to be in its said secured location or locations and/or situation;

c) the secured location or locations and/or situation being arranged so that with the security sensitive item and its related RFID member in the secured location or locations and/or situation either a lack of a response from the related RFID member or a response or responses of a certain character would indicate that the security sensitive item is in the secured location or locations and/or secured situation;

d) said control/interrogating apparatus being arranged so that in a situation where the interrogating of the RFID member does not result in said lack of response that would indicate the security sensitive item is in the secured location or locations and/or secured situation or does result in said lack of a response or responses of a character that indicates the security sensitive item is in the secured location and/or secured configuration, there is generated a communication(s) and/or an occurrence (s) designed and/or arranged to result in a remedial step or steps to accomplish having the security sensitive item in said secured location or locations and/or secured situation and/or initiating some other remedial course of action.

26. The system as recited in claim 25, wherein said secured location or locations is provided as an electromagnetically shielded location so that when the security sensitive item is located in the secured location or locations, the security sensitive item is shielded from an interrogation signal.

27. The system as recited in claim 25, wherein the security sensitive item is arranged to have a secured situation by which another item or items is maintained in a secured location or locations and/or situation, and said security sensitive item is arranged to have a non-secured situation where said another item or items is in a non-secured location or locations and/or non-secured situation, and wherein said security sensitive item comprises a containing member having a secured configuration wherein another item or items are securely contained in said containing member and having a non-secured configuration wherein an item or items in the containing member are more susceptible to be removed from the containing member.

28. The system as recited in claim 27, wherein said containing member has a locking mechanism, and said locking mechanism as a locked position and an unlocked position, said locking mechanism being arranged so that in the unlocked position, there is either a lack of response to an interrogation or a response of a character indicating that a locking mechanism is in an unlocked configuration.

29. The system as recited in claim 25, wherein said area where the security sensitive item is located is a secured area where one or more persons are present during the operating periods, and is or are engaged in an activity or activities which would reasonably require that the security sensitive item would at least sometimes be in a non-secured location or locations and/or situation within the secured area.

30. The system as recited in claim 29, wherein the generating of a communication(s) and/or generating the occurrence(s) is initiated in a situation where c) a person in the secured area is approaching an exit from the secured area, is in proximity to said exit, or is passing through said exit; and d) this occurs during a non-operating time period or in some other time period where the non-secured location or locations and/or non-secured situation of the security sensitive item is not an acceptable security risk.

31. The system as recited in claim 30, wherein said communication and/or communications is or are directed to the person or persons who are approaching, in proximity to, or passing through the exit.

32. The system as recited in claim 31, wherein said communication(s) is selected from a group comprising a visual communication, and aural communication and a combination thereof.

33. The system as recited in claim 30, wherein said invention comprises creating a physical impedance to the person or persons who is or are approaching, in proximity to or passing through the exit.

34. The system as recited in claim 33, where there is a second exit from the secured area, so that in an emergency situation, the person or persons are able to pass through the second exit.

35. The system as recited in claim 30, wherein an alerting communication is generated by the person or persons passing through the second exit.

36. The system as recited in claim 25, wherein there is a plurality of security sensitive items each having a related RFID member, and each of the RFID members are interrogated.

37. The system as recited in claim 36, wherein at least one of the security sensitive items has in its secured location and/or situation, its RFID member situated so as to receive an interrogating signal, said system further comprising a monitoring member which is located to ascertain that said at least one of the security sensitive items having the RFID member that responds to interrogation is in its secured location or situation.

* * * * *

UNITED STATES PATENT AND TRADEMARK OFFICE

CERTIFICATE OF CORRECTION

PATENT NO. : 6,774,782 B2
DATED : August 10, 2004
INVENTOR(S) : Runyon et al.

It is certified that error appears in the above-identified patent and that said Letters Patent is hereby corrected as shown below:

Column 1,
Line 26, please delete “roms” after “secured” and insert -- rooms --.

Column 3,
Line 53, please delete “form” after “operated” and insert -- from --.

Column 7,
Line 50, please delete “these” after “the”.

Column 8,
Line 5, please delete “container-which” after “in a” and insert -- container which --.

Column 12,
Line 7, please delete “oral” after “the” and insert -- aural --.
Line 11, please delete “34” after “32-” and insert -- 44 --.
Line 38, please delete “right” after “read/” and insert -- write --.

Column 15,
Line 18, please delete “10” after “bolt” and insert -- 110 --.

Signed and Sealed this

Twenty-eighth Day of December, 2004

JON W. DUDAS
*Director of the United States Patent and Trademark Office*